US009811969B2

(12) United States Patent
Salzman et al.

(10) Patent No.: US 9,811,969 B2
(45) Date of Patent: Nov. 7, 2017

(54) REMOVABLE FAN ASSEMBLY PROVIDING MULTI-DIRECTIONAL AIR FLOW FOR A WAGERING GAME MACHINE

(71) Applicant: WMS Gaming Inc., Waukegan, IL (US)

(72) Inventors: Scot W Salzman, Buffalo Grove, IL (US); Aaron W Levinsky, Park Ridge, IL (US); Sten H Mejenborg, Cumming, GA (US); Christopher J Talko, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 255 days.

(21) Appl. No.: 14/673,047

(22) Filed: Mar. 30, 2015

(65) Prior Publication Data

US 2016/0292959 A1 Oct. 6, 2016

(51) Int. Cl.
*G07F 17/32* (2006.01)

(52) U.S. Cl.
CPC ..... *G07F 17/3216* (2013.01); *G07F 17/3223* (2013.01); *G07F 17/3241* (2013.01)

(58) Field of Classification Search
CPC ..... G07F 17/3202; G07F 17/3216; G07F 17/3223; G07F 17/3241
See application file for complete search history.

(56) References Cited

U.S. PATENT DOCUMENTS 6,333,851 B1 * 12/2001 Shih ..... G06F 1/20 165/104.33
6,400,567 B1 6/2002 McKeen et al. ..... 361/695
6,491,298 B1 12/2002 Criss-Puszkiewicz ... 273/148 R
6,768,640 B2 7/2004 Doblar et al. ..... 361/695
7,280,356 B2 10/2007 Pfahnl et al. ..... 361/695
(Continued)

OTHER PUBLICATIONS

Sun SPARC® Enterprise T2000 Server Service Manual, Chapter 4: "Replacing Hot-Swappable and Hot-Pluggable FRUs", pp. 4.1-4.12 [online]. Sun Microsystems, Apr. 2007 [retrieved on Mar. 23, 2015]. Retrieved from Internet: < URL: docs.oracle.com/cd/E19076-01/sparc.t2k/819-7989-10/ >.

*Primary Examiner* — Dmitry Suhol
*Assistant Examiner* — David Duffy
(74) *Attorney, Agent, or Firm* — Marvin A. Hein

(57) ABSTRACT

A gaming system internally secures a modular, critical-electronics central processing unit (CPU) box enclosure having various security features, a power source, a power regulator module, a removable fan assembly, and a back-plane providing connection between all the other elements contained within the housing. The removable fan assembly is a modular, hot-swappable, encased unit that provides air flow in a plurality of directions using a corresponding plurality of individually sensed and controlled fans. The fan assembly can be removed during operation of the wagering game machine without interfering with the operations of any other electronic component and without breaking one or more validated seals of the enclosure, the validated seals enabling the gaming system to perform a wagering game having regulatory approval in a given jurisdiction. The removable fan assembly is coupled to one or more processing units that detects, monitors, and controls the operation of the individual fans the fan assembly.

20 Claims, 9 Drawing Sheets

(56) References Cited

U.S. PATENT DOCUMENTS

| | | | | |
|---|---|---|---|---|
| 7,708,640 | B2 | 5/2010 | Burak et al. | 463/30 |
| 7,885,066 | B2 | 2/2011 | Boyden et al. | 361/695 |
| 8,125,779 | B2 | 2/2012 | Aybay et al. | 361/695 |
| 8,282,492 | B2 | 10/2012 | Greenberg et al. | 463/46 |
| 2007/0047200 | A1* | 3/2007 | Huang | G06F 1/20 361/695 |
| 2007/0155507 | A1* | 7/2007 | Gatto | A63F 13/12 463/42 |
| 2010/0093445 | A1 | 4/2010 | Mattice et al. | 463/46 |
| 2010/0099487 | A1 | 4/2010 | Canterbury et al. | 463/25 |
| 2012/0120596 | A1 | 5/2012 | Bechtolsheim | 361/679.48 |
| 2013/0244795 | A1 | 9/2013 | Waxman et al. | 463/46 |

* cited by examiner

REMOVABLE FAN ASSEMBLY PROVIDING MULTI-DIRECTIONAL AIR FLOW FOR A WAGERING GAME MACHINE

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to a hot-swappable removable fan assembly having multi-dimensional air flow for an electronic wagering game machine.

BACKGROUND OF THE INVENTION

As computing hardware, programming, and information processing becomes more complex, the generation of heat from electronic equipment and internal components increases. The removal of heat from electronic gaming machines and internal modules becomes very important to maintain machine operation and overall life of the gaming machines.

SUMMARY OF THE INVENTION

According to one embodiment of the present invention, a gaming system comprises a casino gaming machine primarily dedicated to playing at least one regulated casino wagering game. The gaming system may be incorporated into a single, freestanding gaming machine. The gaming machine may include a secure gaming cabinet containing components associated with the casino wagering game including a set of modular components. The modular elements may include a backplane, a power source, a critical-electronics enclosure, and a fan assembly. The power source is removably attached to the backplane. The critical-electronics enclosure is removably attached to the backplane and the enclosure contains game-logic circuitry that determines game outcomes of the at least one regulated casino wagering game. The enclosure further has a validated seal that is required for operating the gaming machine under regulatory approval in a given jurisdiction. When the gaming machine has a validated seal, opening the enclosure or detaching the enclosure from the backplane irreversibly invalidates the validated seal. The fan assembly is removably attached to the backplane and has plurality of fans. At least one of the plurality of fans moves air in a first direction to directly cool the game-logic circuitry in the enclosure. At least one other fan of the plurality of fans moves air in a second direction. The removal or replacement of the fan assembly does not impact or invalidate the validated seal of the gaming machine as it operates continuously in accordance with regulatory requirements.

According to another embodiment of the present invention, a gaming system comprises a casino gaming machine primarily dedicated to playing at least one regulated casino wagering game. The gaming system has a set of modular components. The modular components include a backplane, a critical-electronics enclosure, and a fan assembly. The critical-electronics enclosure is removably attached to the backplane. The enclosure contains game-logic circuitry that operates to determine game outcomes of the at least one regulated casino wagering game. The enclosure also has a validated seal required for a regulatory approval of the casino wagering game in a particular operating jurisdiction. When a validated seal is present, opening the enclosure or detaching the enclosure from the backplane irreversibly invalidates the seal. The fan assembly is removably attached to the backplane. The fan assembly comprises a plurality of fans. At least one of the plurality of fans primarily forces air in a first direction for directly cooling the game-logic circuitry in the enclosure. At least one other fan of the plurality of fans primarily forces air in a second direction. The fan assembly may be removed or replaced without invalidating the validated seal as the gaming machine operates continuously in accordance with the regulatory requirements.

According to yet another embodiment of the invention, a computer-implemented method for cooling one or more internal modular components of a gaming system primarily dedicated to playing at least one regulated casino wagering game is described. The gaming system includes a secure gaming cabinet, an electronic display device, and an electronic input device. The gaming cabinet is constructed to house components associated with the casino wagering game. The electronic display device and the electronic input device are coupled to the gaming cabinet. The gaming cabinet houses a set of modular components. The modular components include a backplane, a power source, a critical-electronics enclosure, and a fan assembly. The backplane electrically couples to the power source, the critical-electronics enclosure, and the fan assembly. The enclosure contains game-logic circuitry that determines game outcomes of the at least one regulated casino wagering game. The enclosure further has a validated seal required for a regulatory approval of the gaming machine in an operating jurisdiction. When a validated seal is present, opening the enclosure breaks the validated seal. The fan assembly has a plurality of fans. The game-logic circuitry generates one or more random elements with the random element generator. In response to a physical input to the electronic input device of the casino gaming machine, a wager input to initiate the casino wagering game is received. The game-logic circuitry determines an outcome of the casino wagering game based, at least in part, on the one or more random elements. The outcome displayed on the electronic display device of the casino gaming machine. The game-logic circuitry grants an award in response to the outcome meeting a predetermined award criterion. The fan assembly is inserted and coupled to the backplane in the cabinet, without invalidating the validated seal, while the modular components coupled to the backplane are operating in accordance with the regulatory approval. The fan assembly is removed and detached from the backplane in the cabinet, without invalidating the validated seal, while the modular components coupled to the backplane are operating in accordance with the regulatory approval. The fan assembly moves air in a first direction and a second direction to cool at least two of the modular components in the housing simultaneously while the fan assembly is coupled to the backplane. At least one of the plurality of fans primarily forces air in the first direction to cool the game-logic circuitry in the enclosure, and at least one other fan of the plurality of fans primarily forces air in a second direction.

Additional aspects of the invention will be apparent to those of ordinary skill in the art in view of the detailed description of various embodiments, which is made with reference to the drawings, a brief description of which is provided below.

Figure 1:
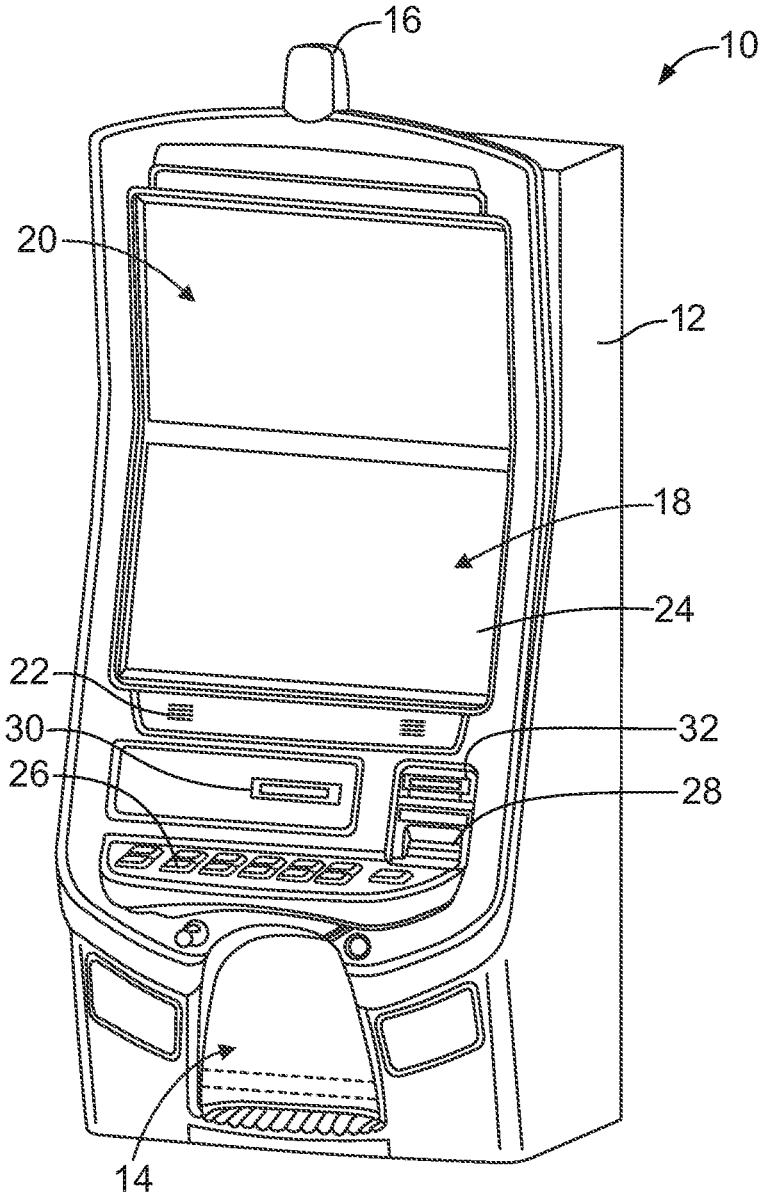
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

In many wagering gaming systems, it is desirable for fan(s) positioned to cool internal components of the wagering game machine to be as physically close as possible to the components the fans intend to cool. As a result, one or more fans may be commonly installed inside the wagering game machine to more effectively cool the many internal components. Also, since a wagering game machine often has multiple modular elements, and each element has internal components generating considerable heat during operation (e.g., game-logic circuitry, video card(s), memory, power sources, etc.), multiple fans may be required that are associated with specific modular components. In the event that one or more fans cooling one or more of these modular elements lose effectiveness, the wagering game machine can quickly overheat, causing shutdown of the machine or irreversible damage to one or more temperature sensitive components. Thus, the ability to quickly clean or replace one or more fans in a wagering game machine cabinet, particularly fans that cool components generating a great deal of heat internal to the machine, is a very important consideration for modern computing equipment in this industry.

Often, there are regulatory restrictions regarding the removal and/or opening of an internal logic box of a wagering game machine housing game-logic circuitry. For example, a gaming jurisdiction may require a regulatory agent be present during the removal or installment of the game-logic circuitry or a seal on a secured box for the game-logic circuitry to ensure no component(s) are improperly configured or tampered with prior to installation and during routine operation. The requirement for an authorized regulatory agent to be present to oversee installation and maintenance of a wagering gaming machine is expensive and may cause considerable delay in operating the wagering game machine on a casino floor; any additional time a wagering game machine is unavailable for play costs an owner/operator even more money. Dependent upon the particular jurisdiction in which the gaming machine operates, opening a secured game-logic circuitry box may initiate a time consuming security protocol involving inspection and/or validation of the internal components of the game-logic circuitry box. Thus, in the event that one or more fans installed in a game-logic circuitry box of the wagering game machine fail, the game-logic circuitry box must be removed, the fan(s) replaced, and the box re-installed (complete with any required observations, validations, testing, etc.), potentially causing significant delay with associated costs.

An embodiment of the present invention provides a way to use a single removable fan assembly having a plurality of fans that simultaneously cool multiple components in a wagering game machine by projecting air in multiple directions. The removable fan assembly provides efficient air flow in multiple directions simultaneously to effectively cool multiple internal modular components of the wagering game machine. The plurality of fans of the removable fan assembly are orientated to provide positive cooling air flow in multiple directions without the further need for redirecting, rerouting, or bending air flow channels. Among other advantages, the described removable fan assembly minimizes resistance and pressure drops caused by turns and bends in an air flow channel, increasing efficiency of cooling equipment in the gaming machine.

Another feature of the removable fan assembly is the ability for removal and replacement during operation of the wagering game machine without disruption of the operation of the internal components. Thus, components of the wagering game machine that require cooling may continue to operate as defective, broken, clogged, or poorly performing fans are cleaned or replaced without any disruption of service or operation. Further, hardware and software validation, boot times, and overall operation of the wagering game machine is significantly improved by enabling fan assembly swapping without interrupting power or function to the other components of the wagering game machine.

Referring to FIG. 1, there is shown a gaming machine 10 similar to those operated in gaming establishments, such as casinos. The gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bar top models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
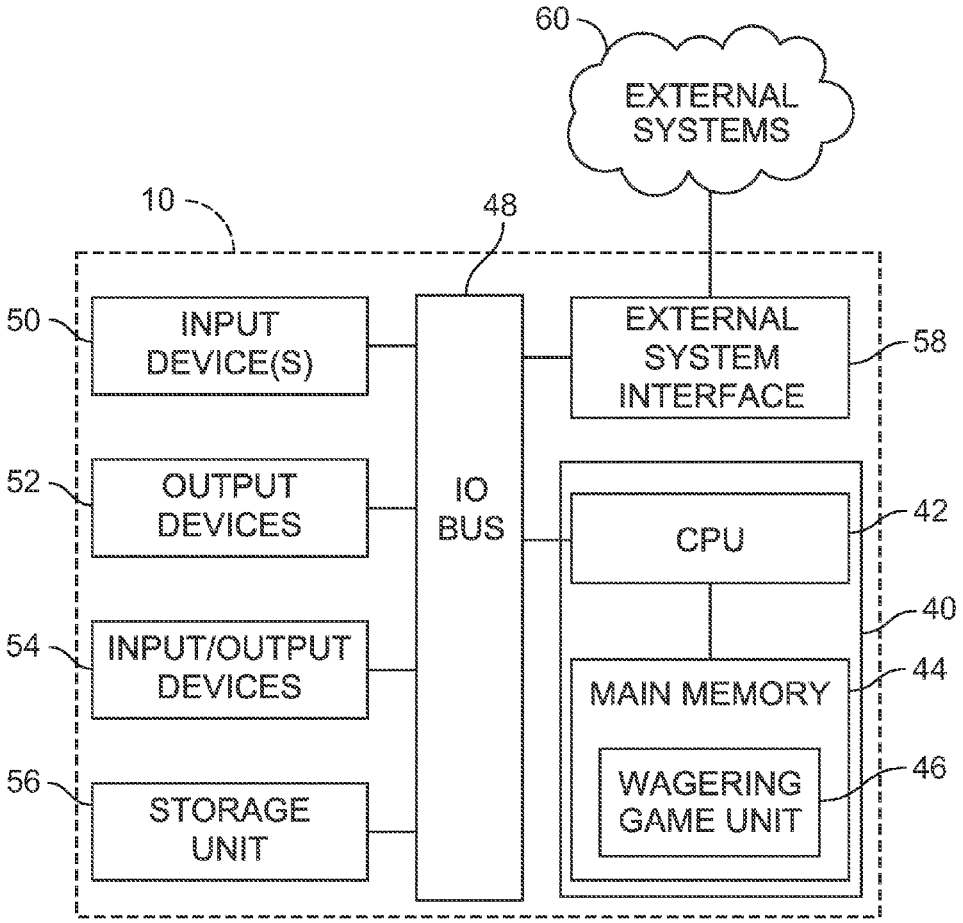
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compares it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
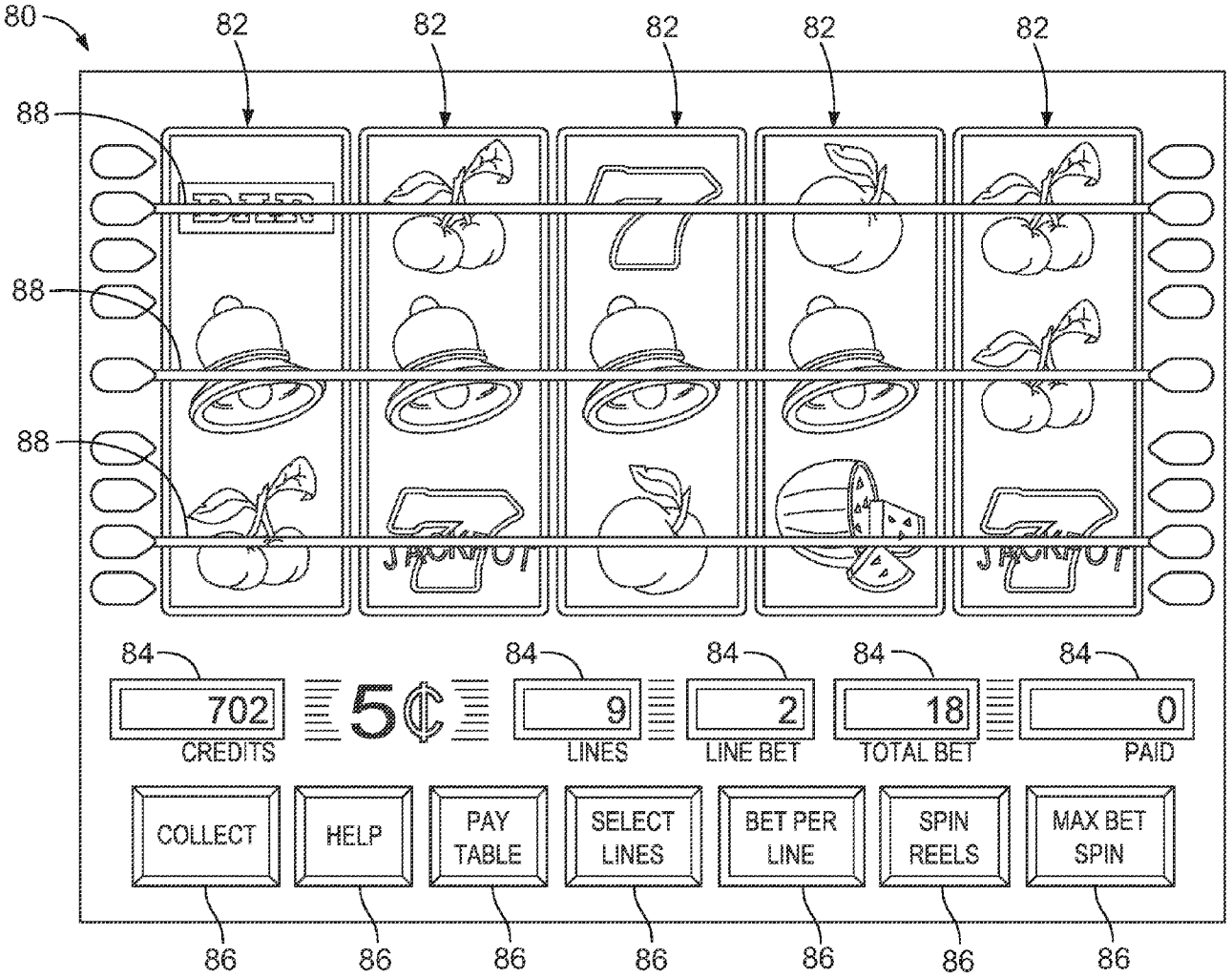
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4:
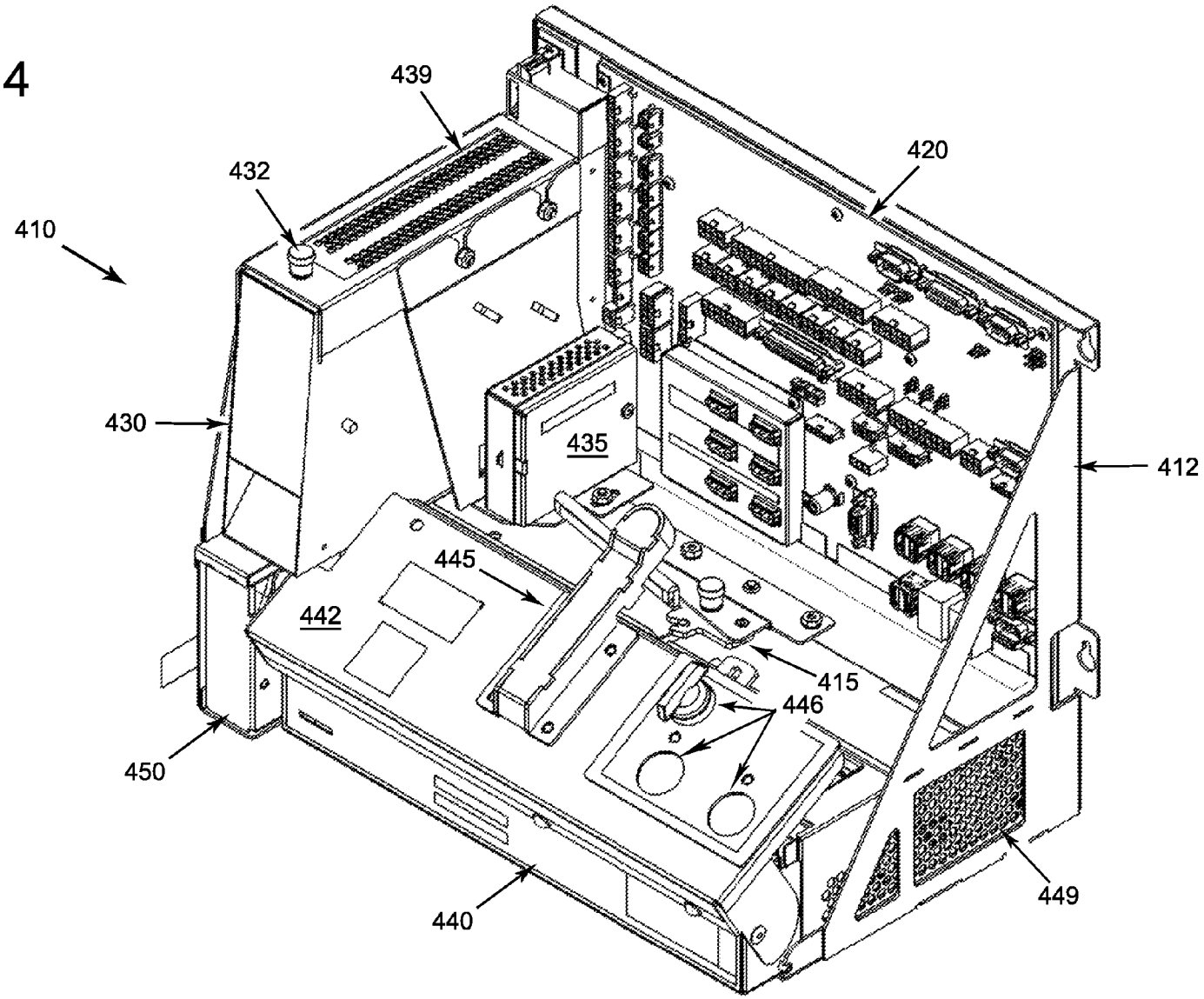
FIG. 4 is a perspective view of a housing mounted internally to a wagering gaming machine in one embodiment having an open latch mechanism providing security to an internal logic box.

Referring now to FIG. 4, a perspective view of an internal housing 410 mounted inside a wagering gaming machine (such as gaming machine 10) is shown in one embodiment. The housing 410 is displayed having a metal frame 412. The metal frame 412 is designed to hold a number of modular components securely such that the various components do not move in the event of shock or tilting of the gaming machine 10. The displayed components secured in the housing 410 by the frame 412 include a backplane 420, a power source 430, a secure central processing unit (CPU) logic box 440, and a removable fan assembly 450.

The backplane 420 is a printed circuit board (PCB) having a variety of physical ports thereon to interface with the various electronic components of the gaming machine. These components may include a wide variety of components not expressly shown that may interact directly with a player, including one or more display devices, one or more audio devices, one or more communicative devices, one or more player input devices, and one or more gaming machine input devices (e.g., bill or ticket acceptor, coin counter, etc.), among many others. The backplane 420 also interfaces with and provides connectivity to other critical components secured to the frame 412, including the power source 430, the CPU logic box 440, and the removable fan assembly 450. Other components may also be mounted to the frame 412 that connect directly to the backplane 420, for example, power regulator 435.

The backplane 420 may additionally include circuitry (and/or additional modular elements or components) that perform specific functions including detection and indication of the connection and operational status of one or more modular components of the frame 412. The backplane 420 may also include one or more components configured to send signals and/or messages to other components of the gaming machine 10, or even to one or more external systems 60 connected by an intervening network. For example, the backplane 420 may generate a connection indication signal driving a light emitting diode (LED) indicating whether a given modular component (e.g., the CPU logic box 440, the removable fan assembly 450) of the frame 412 is currently (un)connected to the backplane 420. Further, the backplane 420 may include circuitry that redundantly performs one or more functions of any component of the gaming machine 10 to ensure critical operation(s) during component failure.

The power source 430 is a modular component fastened to the frame 412 by pin 432. The power source 430 may be detached, uncoupled, and removed from the frame 412 and the backplane 420 by releasing pin 432 and pulling the power source 430 free from the enclosing slot. A set of mesh exhaust vents 439 are located on opposite ends of the power source 430 and allow moving air to flow over and cool the internal components. In one embodiment, the power source 430 is installed vertically in order to better leverage cooling convectional air flow, allowing warmed air to escape through vents 439 at the top of the power source 430 unit.

The power source 430 receives power from an external source (for example, an electrical socket, not shown) and propagates power to electronic components of the wagering game machine 10. The power source 430 may transform incoming alternating current (AC) into specific ranges of direct current (DC) that are required for use by one or more of the electronic components of the wagering game machine 10. In one embodiment, direct current is forwarded by the power source 430 to a power regulator 435 that transforms the received direct current into direct current for use by one or more specific system components. In another embodiment, the power regulator 435 may be housed within the power source 430, either by modular addition or by circuitry integrated into one or more internal components of the power source 430. In one embodiment, the power provided as a result of the power source 430 is transferred through the backplane 420 to the power regulator 435, and transformed voltage from the power regulator 435 may be provided to other system components also through the backplane 420. In other configurations, the power source 430 and/or the power regulator 435 may provide power to one or more system components directly using a visible wire, cable, or other power bus.

The CPU logic box 440 couples to the backplane 420 using a set of projecting PCB contacts (not shown) corresponding to a set of connecting slots 447 in the backplane 420. Additionally, the CPU logic box 440 has a set of mesh exhaust vents 449 located on opposite ends of the CPU logic box 440 and allow moving air to flow over and cool the internal components. The CPU logic box 440 may or may not have internal fans to provide air displacement and movement through the CPU logic box 440 to remove heat from its internal components.

In many embodiments, the CPU logic box 440 is considered a critical-electronics enclosure of the gaming machine 10 due to the housing of components that are required to perform one or more regulated wagering games. The CPU logic box 440 may include one or more of game-outcome logic circuitry (e.g., game-logic circuitry 40), secured and protected processing unit(s) (e.g., CPU 42), secured memory segments or modules (e.g., memory 44), a random number generator, game assets, etc., having regulatory approval from a gaming control board or commission that are verified by a trusted authentication program in the main memory 44 prior to game execution. The CPU logic box 440 may additionally be considered a critical-electronics enclosure due to the express containment of the game-outcome logic circuitry that specifically determines wagering game outcomes for the wagering game machine 10. That is, in that at least the random number generator programming and/or game-outcome logic circuitry may be required to operate the gaming machine 10 in a regulatory-approved manner, the electronic circuitry contained in the CPU logic box 440 enclosure is critical to operation. Further, in order to fulfill all regulatory requirements in a specific jurisdiction, an authorized regulatory agent may be required to install or verify a validated seal particular to the CPU logic box 440 enclosure due to the critical nature of the internal electronic circuitry.

The CPU logic box 440 is secured in place by a secure cabinet latch mechanism 445 mounted to a door 442 that opens to expose the internal components of the CPU logic box 440. The latch 445 may be a multi-part mechanical securing device that not only secures the CPU logic box 440 in place, but may also provide tamper-proof or tamper-evident sealing as part of a validated seal. In some cases, the CPU logic box 440 and/or the latch 445 may only be opened, removed, or replaced in the presence of an authorized regulatory agent to maintain a required level of security for continued operation under regulatory approval. The latch 445 may mate with a connecting latch mechanism 415 that may be an integrated or modular part of the frame 412. The latch mechanism 415 may additionally be mounted to the frame 412 and positioned to mate with the latch 445 to provide a way to secure the CPU logic box 440 to the frame 412 while the latch mechanism 415 and latch 445 are engaged. The latch mechanism 415 may additionally be equipped with tamper-proof or tamper-evident sealing as part of a validated seal to signify integrity of the CPU logic box 440 as a critical-electronics enclosure. In one embodiment, the latch mechanism 415 is used to release a mating component of the latch 445 enabling the CPU logic box 440 to be physically detaching from the backplane 420 and removed from the frame 412. Removal of the CPU logic box 440 may occur separately from any access to internal components of the CPU logic box 440 via door 442.

The CPU logic box 440 may also utilize one or more key latch mechanisms 446 that supplement or complement the latch 445, and may further serve to restrict the opening (and closing) of the door 442, even while the CPU logic box 440 is removed from the frame 412. The key latch mechanisms 446 may be equipped to accept one or more physical keys required to rotate a latching mechanism 446 on the interior of the CPU logic box (mounted to the door 442) and allow the CPU logic box 440 to be opened for access to internal components. In one embodiment, the latch 445 may hold the CPU logic box 440 in place within the frame 412, but when released, the CPU logic box 440 requires further security measures, for example, manipulation of multiple key latch mechanisms 446, to access one or more of the internal components within by opening door 442. In other embodiments, the operation of the latch mechanism 415, the latch 445, and the key latch mechanisms 446, may be integrated into a single unified mechanism.

In one embodiment, a validated seal may include a piece of special tamper-evident tape used and applied by a regulatory agent to ensure the CPU logic box 440 has not been tampered with since the last validation. In another embodiment, a validated seal may include one or more security ties and/or security wraps that provide tamper-evident binding of the latch 445, the latch 445 to the latch mechanisms 446, latch 445 to the CPU logic box 440, CPU logic box 440 to the frame 412, etc. In one embodiment, a validated seal may include any mechanism that provides an irreversible invalidation of the seal when the validated seal is breached. A validated seal may be placed on the latch mechanism 415, the CPU logic box 440, the door 442, the latch 445, one or more key latches 446, internal components of the CPU logic box 440, or any combination of these. Another example of a validated seal may include a regulatory sticker placed on an additional physical device, like a bar or locking device, bolted into place on the CPU logic box 440, preventing access to internal components of this critical-electronics enclosure. Another example of viable security measures may include the provision for multiple, simultaneous key latches to be activated at the same time to set or break a validated seal, with or without additional measures like tamper-evident tape. That is, a validated seal may include a single CPU lock latch mechanism 446, dual CPU lock latch mechanisms 446, a single CPU lock latch mechanism 446 and security tape, dual CPU lock latch mechanisms 446 and security tape, one or more security tie wraps, etc., or any combination of these. The validated seal may include one or more electronically detectable and recordable signals using sensors, connectors, video input, etc. In short, the security device(s) and validated seal(s) provide a way to reasonably ensure that the internal components of the CPU logic box 440 have not been tampered with (without visible, verifiable evidence), such that the contents of the critical-electronics enclosure CPU logic box 440 may obtain, sustain, or verify regulatory approval to legally execute the casino wagering game in the operating jurisdiction. The provision for any type of validated seal is within the spirit and scope of the invention.

In one embodiment, the electronic gaming machine 12 containing frame 412 may be operated in a jurisdiction that requires two distinct validated seals to operate the electronic gaming machine 12 under a set of current regulations. One validated seal may be a first piece of specialized tape spanning the latch 445, and another validated seal may be a second piece of specialized tape spanning the key latches 446. Thus, in order to operate the electronic gaming machine 12 to perform a regulated casino wagering game having regulatory approval, both of the required validated seals must be intact and undisturbed when inspected by a regulatory agent of the given jurisdiction.

Individual internal components of the CPU logic box 440 may also be required to exhibit validated seals, such as central processing units (such as CPU 42), memory units (such as memories 44, 56), and the game-logic circuitry 40 as a whole. That is, there may be validated seal(s) that exist internal to the CPU logic box 440. Thus, there may be a number of layers of security that may be required to operate the gaming machine 10 having regulatory approval. Further, once a validated seal is broken (i.e., invalidated), a set of one or more require procedures may be required to reinstate (i.e., re-validate) the invalidated seal. Among these, use of physical specialized tape (or another mechanism) for resealing of the CPU logic box 440, followed by a reboot, clearing of one or more random access memories, electronic revalidation, verification, or authenticity of files or memories, and/or complete power-down (e.g., shutdown) and restarting of the gaming machine 10 may be required to obtain a proper validated seal required to operate the gaming machine 10 under regulatory approval in the given jurisdiction.

Further validation seals may include electronic determination, storage, and comparison of serial numbers, hash values, and/or electronic signatures associated with one or a number of components of the gaming machine 10, including the backplane 420, the integrated components mounted on or in the backplane 420, the CPU logic box 440, one or more internal components of the CPU logic box 440, or any component electrically coupled to the gaming machine 10. The combination of a number of physical and electronic security measures may be combined to successfully obtain, sustain, or maintain a given validation seal for regulatory approval of operation in a given jurisdiction. For example, a machine may be required to reboot and authenticate the hardware and software components of the CPU logic box 440 (and other system components like the backplane, etc.) in order to obtain a validated seal for operating the gaming machine 10 under regulatory approval.

In most cases, a validated seal includes a human initiated process by a jurisdictional regulatory agent authorized to grant validated seals for the given jurisdiction. This may often be time consuming and expensive, further requiring the physical visitation of an authorized person to the gaming machine 10 being validated. Any requirement for hardware and/or software verification, authorization, and associated signature derivation and comparison adds more complexity in added time and processing power to complete these required tasks. Thus, once a validated seal is obtained, it is very desirable to find a way to perform routine maintenance of the gaming machine 10 without invalidating the previously validated seal, avoiding any extended downtime, expense, and requirement for a regulatory agent to be involved at all.

The removable fan assembly 450 is shown securely positioned in a particular section of the frame 412, mated and coupling to the backplane 420. The removable fan assembly 450 receives power and signaling from the mated connection to the backplane 420. The removable fan assembly 450 may be removed (i.e., detached) from the backplane and replaced (i.e., inserted) in a hot-swappable manner. That is, no powered-down or special operational state required for the removable fan assembly 450 prior to removal or replacement.

Also, it is important to note that the modular nature of the removable fan assembly 450 causes detachment and insertion not to interfere with any of the validated seal security requirements specifically in place for the CPU logic box 440 of the gaming machine 10 as a whole. The presence of the removable fan assembly 450 is completely independent from the CPU logic box 440 and does not impact, alter, or affect the validation seal(s) previously granted for the CPU logic box 440. That is, the removable fan assembly 450 can be modularly removed from the housing 410 and frame 412, while the other modular components of the frame 412 continue to receive power and operate in the standard fashion, including any critical-electronics enclosure (e.g., the CPU logic box 440). For example, removing the removable fan assembly 450 does not at all impact the operation of the power source 430, the power regulator 435, or the CPU logic box 440 at all; these modular elements continue to receive power uninterrupted and continue operating as if the removable fan assembly 450 had not been removed. Further, any validated seals for the CPU logic box 440 (or other component) that may be operating, are not disrupted. This allows the removable fan assembly 450 to be modularly removed, cleaned, and replaced without any interruption to the CPU logic box 440 or other components. One or more functional elements of the CPU logic box 440 may be programmed to be responsive to the removal and insertion of the removable fan assembly 450, but the delivered power and operation of the CPU logic box 440 remains independent from the presence, absence, or operational state of the removable fan assembly 450.

Devices routinely utilized to cool the internal components of a typical gaming machine 10, including fans, may often become dirty, clogged, or fail, minimally due to being constantly operated during operation of the machine. The removable fan assembly 450 provides an efficient, single modular unit that simultaneously cools multiple cabinet devices of the frame 412 using a plurality of fans oriented to provide airflow in multiple directions at the same time. Additionally, the removable fan assembly 450 can be removed and/or replaced without disruption or violation of previously obtained validation seals for gaming machine 10 components.

Figure 5:
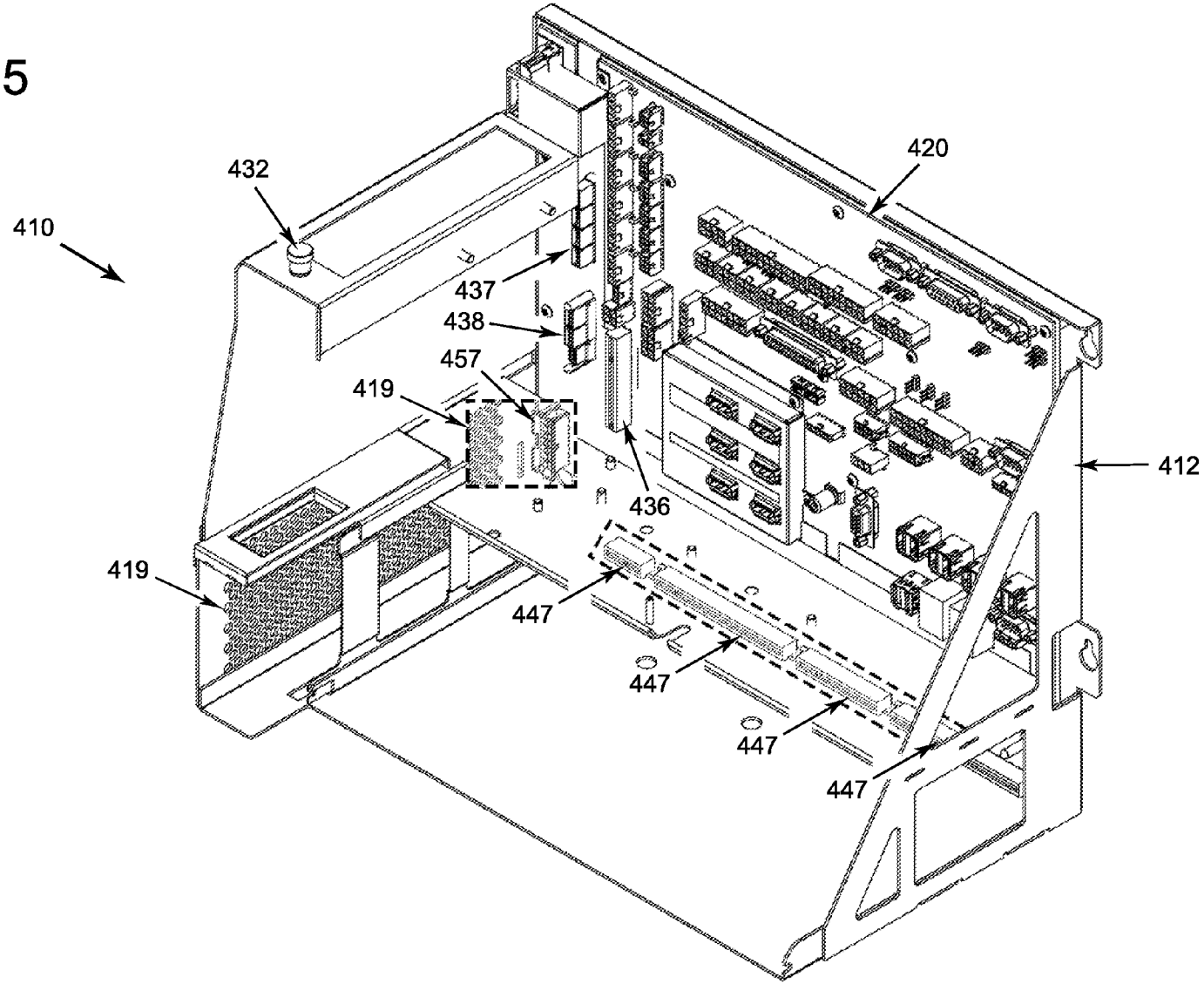
FIG. 5 is a perspective view of a housing mounted internally to a wagering gaming machine in one embodiment having the modular components removed and cut-away views showing connecting ports of the backplane for the logic box and the removable fan assembly.

Referring now to FIG. 5, the coupling of the various modular components of the frame 412 to the backplane 420 occurs through the shown corresponding matching electrical ports. For example, the power source 430 couples to the backplane 420 via port 437 and port 438, while the power regulator 435 couples to the backplane 420 via port 436. In one embodiment, the power source 430 receives AC power via port 437, transforms the AC power into DC power, and delivers the DC power to the backplane 420 via port 438 for distribution to other components of the system, for example, power regulator 435 via port 436. The CPU logic box 440 receives power and communicates with other components connected to the backplane 420 via ports 447, shown partially in a cut-away view of FIG. 5. The removable fan assembly 450 couples to the backplane 420 via port 457, also shown in a cut-away view of FIG. 5. The number of ports, the type of ports, configuration of ports, and the signal transfers within each port coupling the backplane 420 to the various components (and the components to each other) may be of any configuration and are not specific to the type shown here.

Figure 6:
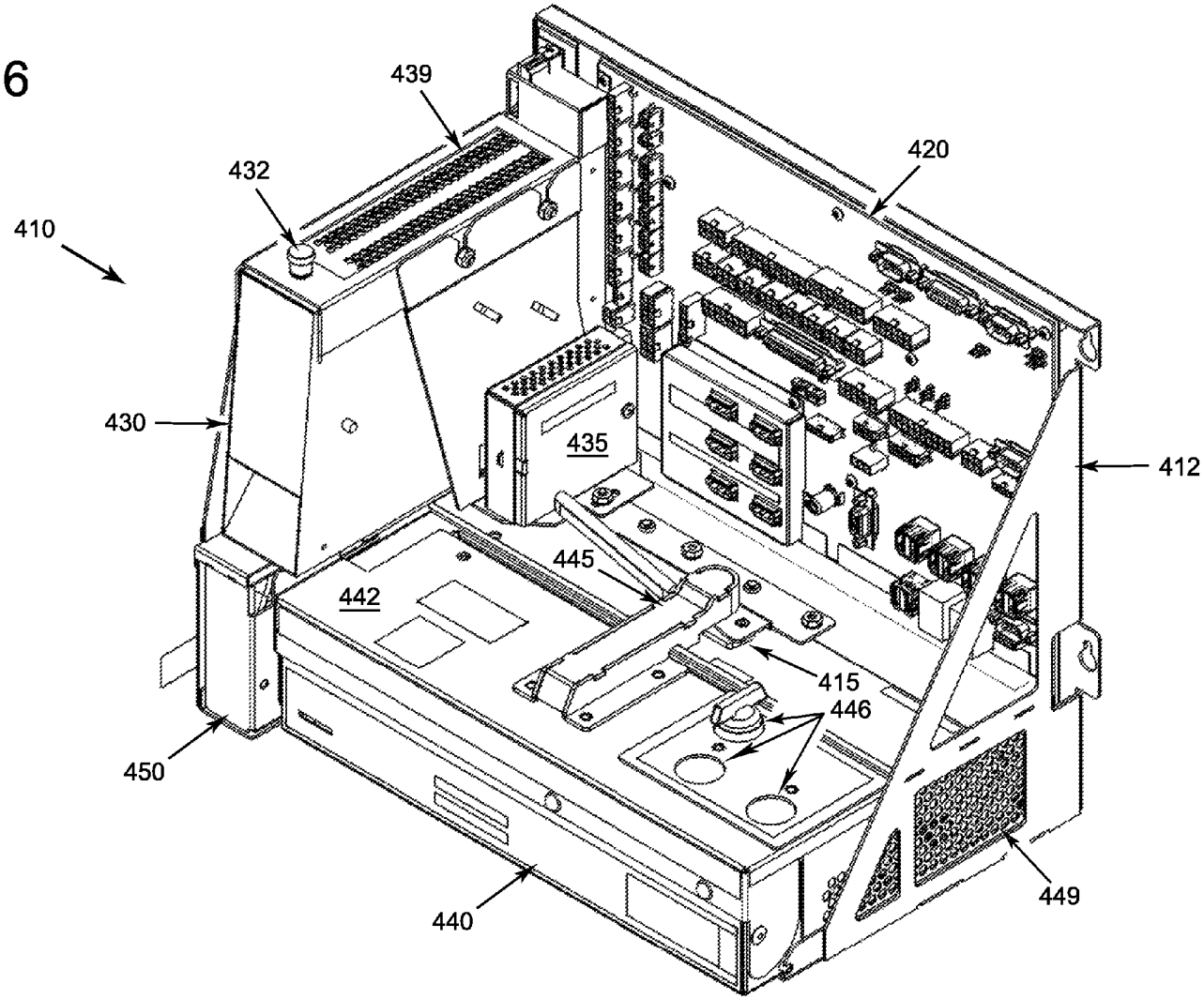
FIG. 6 is a perspective view of a housing mounted internally to a wagering gaming machine in one embodiment where the power source, power regulator, logic box, and removable fan assembly are fully seated and coupled to the backplane.

Referring now to FIG. 6, the housing 410 mounted internally to a wagering gaming machine having the power source 430, power regulator 435, CPU logic box 440, and removable fan assembly 450 fully seated and coupled to the backplane 420 is shown. The latch 445 is closed ensuring a secure connection of the CPU logic box 440 to the backplane 420. The latch 445 must be used to physically remove the modular CPU logic box 440 from the housing 410 and frame 412, and generally, to disengage the CPU logic box 440 from the backplane 420. In some jurisdictions, disengaging the latch 445 requires regulatory observation and/or a requirement for enhanced verification or testing of various components of the CPU logic box 440 to maintain or obtain one or more regulatory validated seals as discussed above for proper regulatory machine operation. The ability for a field technician to remove and replace the removable fan assembly 450 during powered and uninterrupted operation of the power source 430 and CPU logic box 440 is of great importance. Since no interruption of the CPU logic box 440 or other internal components of the housing 410 occurs, the removable fan assembly 450 can be dynamically and arbitrarily removed, cleaned, reinserted, or replaced, without any disruption to the regulatory approved operational portions of the gaming machine 10, including the breaking of one or more validated seals. The advantage of being able to clean and swap dirty and broken fans without powering down the gaming machine 10 (then requiring completion of a rebooting process) and breaking validated seals cannot be overstated. Many wagering game machines 10 require considerable time to complete booting processes due to the required electronic validation of programmatic code and stored memory modules, hardware and software configurations, network and/or system configuration and registration, etc. Also, obtaining one or more validated seals for regulatory approval of the component(s) of a gaming machine 10, often requiring an authorized human regulatory agent to be present or consulted while the seal is granted and applied, is costly and time consuming. The ability to instantly swap the removable fan assembly 450 without disrupting the operation of operational components of a gaming machine 10 is a major advancement.

Figure 7:
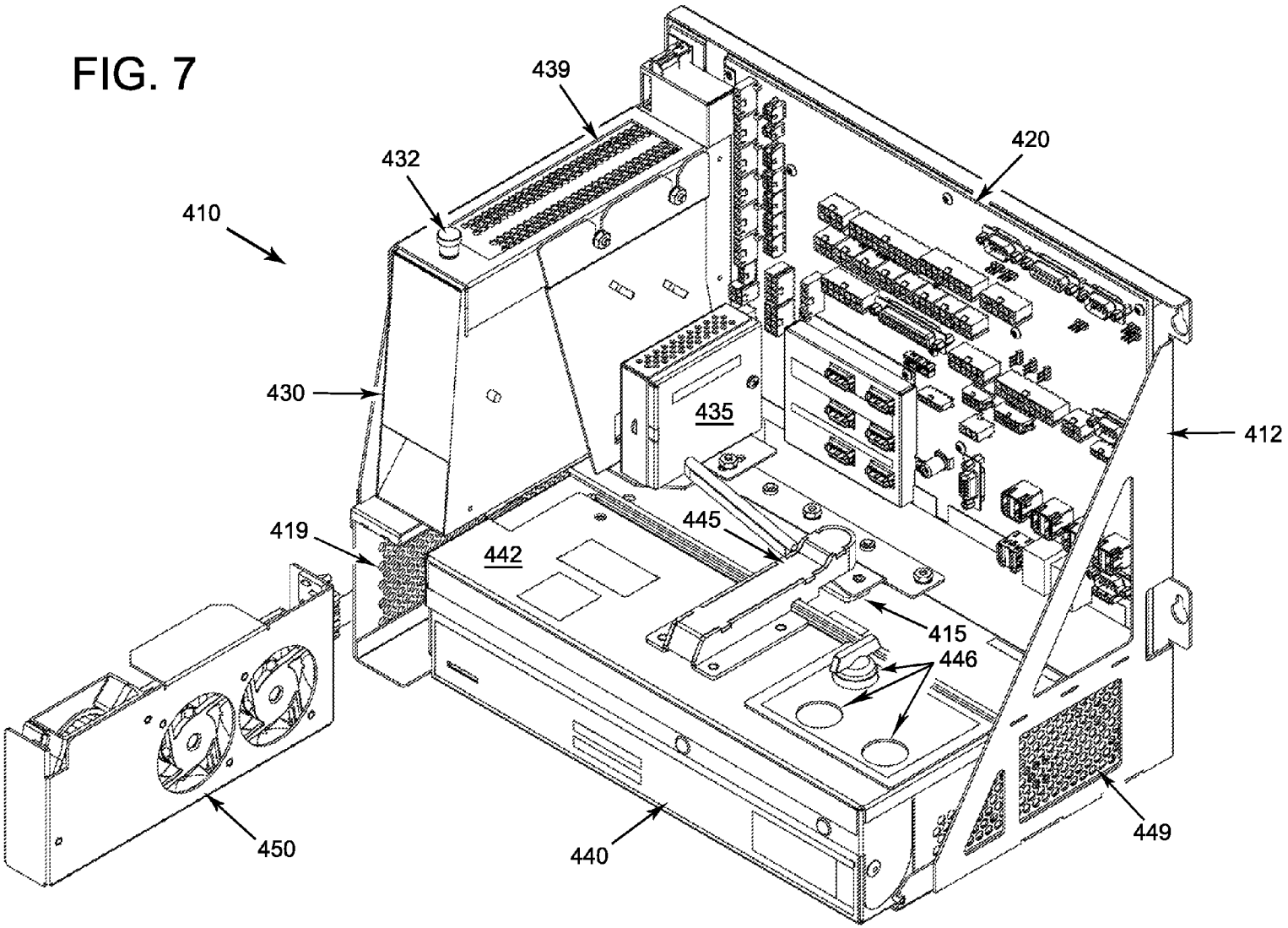
FIG. 7 is a perspective view of a housing mounted internally to a wagering gaming machine in one embodiment showing the removable fan assembly disengaged from the housing of the wagering game machine.

Referring now to FIG. 7, the removable fan assembly 450 completely removed from the slot in the housing 410 is shown. This vantage allows a clear view of the open air mesh 419 that the removable fan assembly 450 uses to pull in cooler ambient air from outside the gaming cabinet 12 to cool the internal system components of the gaming machine 10. When the removable fan assembly 450 is fully seated and secured, ambient air is pulled into the removable fan assembly 450 from outside the gaming cabinet 12 and forced out of the removable fan assembly 450, through the adjacent modular components of the housing 410. The differences in air pressure caused by the removable fan assembly 450 causes forced air to exit the housing 410 via the exhaust vents 439, 449, removing heat of the internal components of the power source 430 and CPU logic box 440.

While the removable fan assembly 450 is disengaged from the backplane 420, the other components of the wagering game machine may continue to operate unimpeded and uninterrupted. The modular components of the housing 410 continue to receive power and maintain any previously granted validated security seals. That is, there is no disruption in the routine operation of the other components of the housing 410, and no security encroachment of the modular components is experienced. The power source 430 continues to operate as intended, providing power to the system components like the power regulator 435 and the CPU logic box 440. The CPU logic box 440 continues to perform programmatic functions, including execution of the game-logic circuitry and driving of video and audio output to one or more output devices coupled to the backplane 420. This is especially important due to the CPU logic box 440 being a critical-electronics enclosure housing game-logic circuitry that requires enhanced levels of security to receive or maintain validated security seals.

The backplane 420 and/or the CPU logic box 440 are able to detect when modular components are actively coupled by using associated circuitry. For example, a red light emitting diode (LED) (not shown) may be present on the backplane 420 that indicates that the removable fan assembly 450 is not coupled to the backplane 420. The circuitry that drives the LED light to shine may be an integrated part of the backplane 420 and/or the CPU logic box 440, or even a modular component coupled to the backplane 420.

Figure 8A:
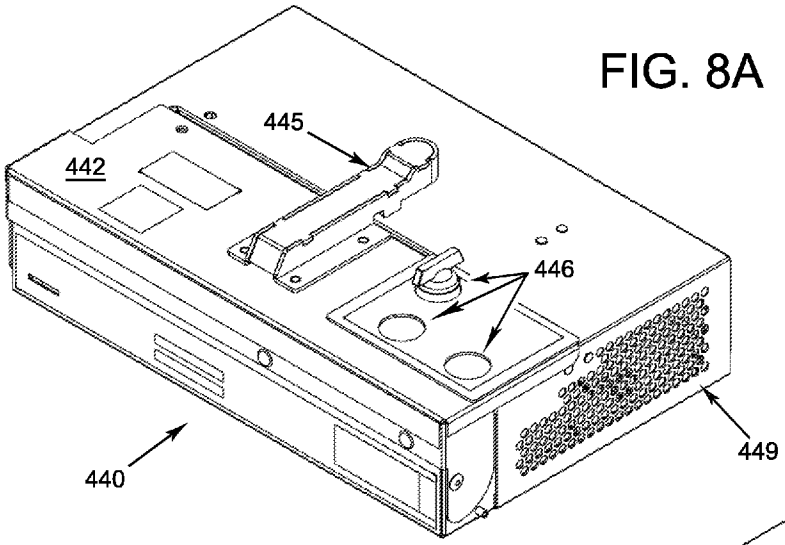
FIGS. 8A-8B are perspective views of the logic box in a respective closed and opened state.
Figure 8B:
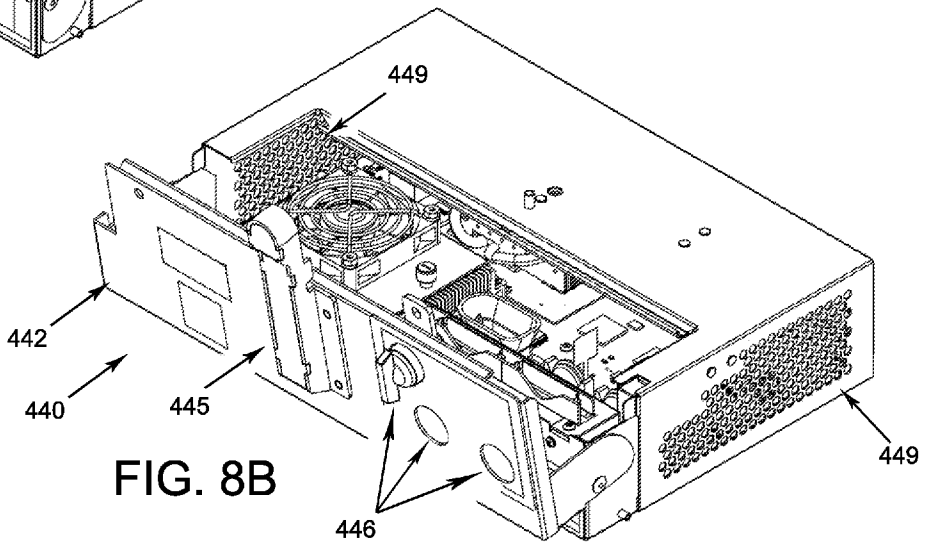
Figure 9A:
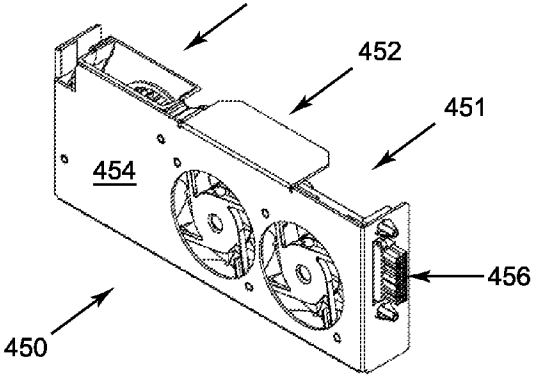
FIGS. 9A-9D are perspective views of the removable fan assembly.
Figure 9B:
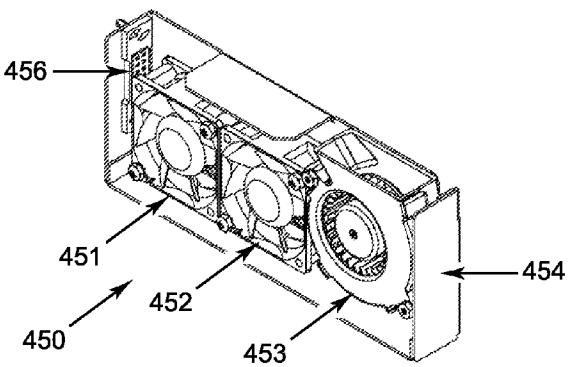
Figure 9C:
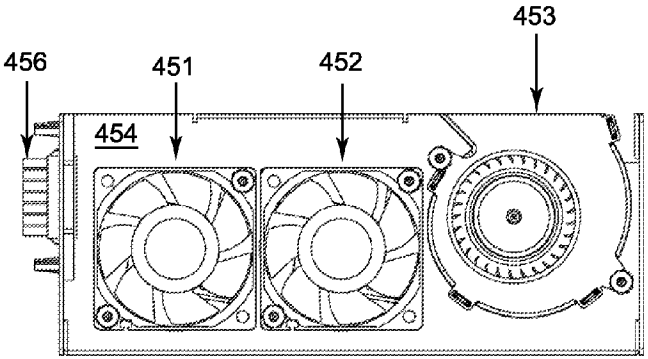
Figure 9D:
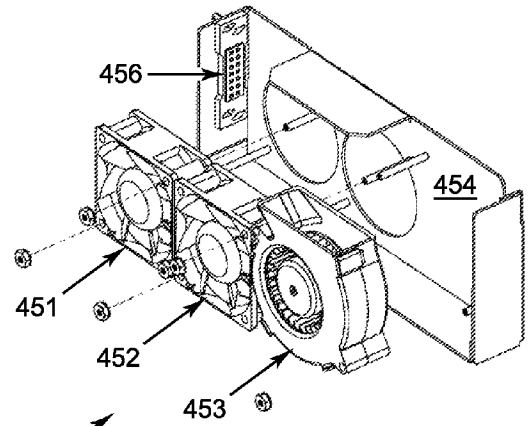

Referring now to FIGS. 8A and 8B, a respective view of the CPU logic box 440 is shown in a closed and open state, respectively, removed from the frame 412. When the door 442 of the CPU logic box 440 is closed, the latch 445 and key latches 446 are in a position that allows the CPU logic box 440 to be equipped with enhanced security features. For example, the key latch mechanisms 446 may be equipped to accept one or more physical keys that are required to open the door 442.

The CPU logic box 440 couples to the backplane 420 using a set of projecting PCB contacts (not shown) corresponding to a set of connecting slots in the backplane 420. Additionally, the CPU logic box 440 has a set of mesh exhaust vents 449 located on opposite ends of the CPU logic box 440 and allow moving air to flow through the CPU logic box 440 and cool the components within.

The CPU logic box 440 is structurally rigid and holds a number of components of the gaming machine 10, including the game-logic circuitry 40. These internal components may include one or more fans internal to the CPU logic box 440 to remove heat from specific components (e.g., CPU 42, video cards, memory modules, etc.). In one embodiment, ambient (cooler) air is forced into the CPU logic box 440 from one or more fans of the removable fan assembly 450, entering from one side via the mesh vents 449. Air flows through the CPU logic box 440 and gathers heat from the internal components of the CPU logic box 440 and exits the CPU logic box 440 via the mesh vent 449 opposite the removable fan assembly 450. The direction of the air flow through the CPU logic box 440 is dependent upon the orientation of the CPU logic box 440, positioning of the removable fan assembly 450, and rotation direction of the associated fans (e.g., fans 451, 452) in the fan assembly 450.

The CPU logic box 440 may be secured in place to the frame 412 by the latch 445 mating with a cabinet latching element 415 mounted on the frame 412. In some cases, the CPU logic box 440 and/or the latch 445 may only be opened, removed, or replaced in the presence of an authorized regulatory agent to maintain a validated seal under a required level of security for continued operation of the gaming machine 10 under regulatory approval. The latch 445 may also provide tamper-proof or tamper-evident sealing as part of a validated seal of the internal contents of the CPU logic box 440. The CPU logic box 440 is designed to particularly house the various components of the game-logic circuitry in a secured manner such that these components are not tampered with, altered, swapped, or manipulated without detectable physical and electronic evidence. The provision for one or more validated seals, including seals granted after a lengthy digital computational verification process, provides a way to ensure that the CPU logic box 440 is operating in a fashion that is compliant with regulatory requirements.

In order to release the CPU logic box 440 for opening or removal, the latch 445 may be required to break (or otherwise invalidate) one or more validated seals that are granted by an authorized regulatory agent of a given operational jurisdiction for the gaming machine 10. In the event that a validated seal is broken (i.e., the seal becomes invalidated), the gaming machine 10 may lose the ability to operate within the jurisdiction under regulatory approval.

Referring now to FIGS. 9A-9D, respective views of the removable fan assembly 450 are shown having three installed fans 451-453 installed within a removable fan assembly housing 454. The plug 456 that mates with port 457 is positioned on one end of the removable fan assembly housing 454. The fans 451-453 plug into a PCB or port (not shown) that convey signals to particular pins of the plug 456. The removable fan assembly 450 uses the interface created by the mating of plug 456 and port 457 to send and receive signals (PWM, control signals, etc.) communicating operational states of the removable fan assembly 450 and the internal component fans 451-453 using the methods described above.

The removable fan assembly 450 and associated operational circuitry work together to enable the provision for power for the fan assembly 405 and fans 451-453, detection of the presence of the removable fan assembly 450, sensing speed and operation of the individual fans 451-453, and controlling speed of the individual fans 451-453. In one embodiment, the removable fan assembly 450 uses an interface having a "blind mate" connector (e.g., plug 456) allowing hot-swappable removal and replacement of the removable fan assembly 450 while the gaming machine 10 is powered and operating. The blind mate connector provides electrical coupling (mating) of plug-to-port via a sliding or snapping action without the need for wrenches or other tools. The blind mate connector is also constructed having self-aligning features that allow for slight misalignments during mating.

In one embodiment, the CPU logic box 440 performs all the processing related to sensing and controlling the fans 451-453 using the digital signals exchanged with the removable fan assembly 450 coupled to the backplane 420. For example, the CPU logic box 440 interprets signals using PWM received from each of the individual fans 451-453 of the removable fan assembly 450 separately. In an alternative embodiment, a dedicated fan controller (not shown) may be used to perform the control and operation of the removable fan assembly 450 using a dedicated module.

The removable fan assembly 450 provides signaling indicating the speed and operational status of each of the installed fans 451-453. Thus, if one or more of the fans 451-453 fail, become hindered during operation, or are operating nominally, the signaling provided by the connections with the removable fan assembly 450 will indicate how each individual fan 451-453 is performing. In the event that the removable fan assembly 450 is removed from the housing 410 (or entirely fails), specialized circuitry may be implemented to visually indicate operational status on one or more output devices, illuminate a light bulb or LED on the interior or exterior of the gaming machine, or even send an alert signal to a central network controller or other external system 60 using wired or wireless communication. For example, one or more software modules or processes may recognize removal of the removable fan assembly 450 (optionally as a "soft tilt" or other dedicated condition), and generate and send an associated alert signal in response.

The fans 451-453 may be operated independently from each other. The fans 451-453 may be selectively operated at lower speeds to reduce noise, and at higher speeds in response to sensing higher temperatures of one or more modular components. The fans 451-453 may be selectively controlled in response to the temperature detected in various regions of the gaming machine 10 to control cooling air flow in multiple directions simultaneously. In the event that one or more of the fans 451-453 slows down, for example, due to dirt, clogging, or wear, the sensing of rotational speeds may indicate potential problems by one or more of the above detailed alert methods, and the particular fan 451-453 can be isolated and the problem addressed. Once determined, the removable fan assembly 450 can be removed while the wagering game machine 10 remains powered up and operating, the faulty fan(s) cleaned, fixed, or replaced in the removable fan assembly 450, and the removable fan assembly 450 may be reinserted into the cabinet frame 412 to resume cooling operations without disruption of any of the other internal components.

There are many types of fans that can be installed into the removable fan assembly 450 and be used to move air to cool components of the wagering game machine. In one embodiment, axial fans and centrifugal fans (also called radial fans) are two types of fans compatible with the removable fan assembly 450. Axial-flow fans have blades that force air to move parallel to the shaft about which the blades rotate. Axial fans blow air linearly along the axis of the fan. Centrifugal fans increase the pressure and speed of air in a stream using rotating impellers. Centrifugal fans accelerate air radially, usually changing the direction of the airflow orthogonally. Centrifugal fans, at a constant fan speed, will pump a constant volume of air rather than a constant mass. Thus, the air velocity in a centrifugal fan system is fixed even though mass flow rate through the fan is not. Centrifugal fans may also be called a "blower", a "squirrel cage fan" (due to similarity in appearance to exercise wheels for pet rodents), or a "scroll wheel". A centrifugal fan has a moving component that consists of a central shaft about which a set of blades, or ribs, are positioned. Centrifugal fans blow air at right angles to the intake of the fan, and spin the air outwards to the outlet (by deflection and centrifugal force). The impeller rotates, causing air to enter the fan near the shaft and move perpendicularly from the shaft to the opening in the scroll-shaped fan casing. Other types of fans, for example, cross flow fans (also called tangential fans) may be used in a different configuration of the removable fan assembly 450. Further, the number of fans used in the removable fan assembly 450 is arbitrary, and can encompass any number or configuration.

A typical computer fan connection may use a series of pins to connect the singular fan to a power source and controller for routine operation, rotation speed sensing, speed control, etc. In one embodiment, the fan connection includes a ground connector, a power connector (e.g., 5V, 12V, or 24V), a "sense" connector providing a tachometer (rotational speed) signal indicating the actual speed of the fan as a pulse train, and a "control" connector providing a pulse-width modulation (PWM) signal providing the ability to adjust the rotation speed dynamically without changing the input voltage delivered to the cooling fan.

PWM operates to alternate a fixed frequency signal between on and off states to produce an emulated analog signal. The speed of each fan is controlled by altering a fraction of a given time cycle providing power for driving the fan. That is, by providing a continuous stream of "on" or "off" signals, a fan may be driven at a given speed by altering the percentage of time that power is sent to the fan during each cycle. This is sometimes called the "duty cycle", and is proportional to the actual fan speed. The PWM signal is used to control a switching power regulator which drives the fan. In one embodiment, for the duration of the "on" pulse, the fan will run with a (full) 5 volt, 12 volt, or 24 volt DC supply, and for the duration of the "off" pulse it will run with no DC supply. Unlike linear voltage regulation (where the fan voltage is proportional to the speed) the fans are driven with a constant supply voltage. Speed control for each fan may be performed based on the control signal, a square wave operating at 25 kHz, with the duty cycle determining the fan speed. In one embodiment, a fan can be driven between about 30% and 100% of the rated fan speed, using a signal with up to 100% duty cycle. The exact speed behavior (e.g., linearly proportional to temperature, inactive or maintaining a minimum speed until a temperature threshold is detected) at lower control levels may be manufacturer dependent. Many motherboards feature firmware and software that regulates these fans based on processor type and sensed computer case temperatures, but any type of circuitry or programming may be employed to create any type of advanced temperature detection and resultant fan rotation paradigms.

In one embodiment, the removable fan assembly 450 provides horizontal axial air flow through the CPU logic box 440 using the axial fans 451 and 452. The removable fan assembly 450 also provides vertical air flow through the power source 430 using a single centrifugal fan 453. The axial fans 451, 452 force air into the CPU logic box 440 to flow through the CPU logic box 440 to exit via exhaust port 449 after cooling the internal components. The centrifugal fan 453 draws ambient air (preferably channeled from the exterior of the gaming machine 10 into the fan assembly 450, e.g., via a vent in the side of the cabinet 12), that forces air upward to cool the internal components of the power source 430, exiting via exhaust vent 439 at the top of the power source 430.

These exemplary fans may be purchased commercially, the axial fans available from JMC Products, 8900 Shoal Creek, Suite 125, Austin, Tex., 78757, as model number 6025-24, and the centrifugal blower available from ebmpapst Inc., 100 Hyde Road, P.O. Box 4009, Farmington, CT, 06034, as model number RL48-19/12, for example. Also, since the fans 451-453 are modular and hot-swappable. That is, the removable fan assembly 450 may be removed, one or more of the fans may be cleaned or replaced, and the removable fan assembly 450 may be replaced while the gaming machine 10 is powered and operating without any disruption to other components. This also provides maintenance without violation of any validated seals of the components of the gaming machine 10, including any internal critical-electronics enclosure charged with performing at least one casino wagering game under jurisdictional regulations (e.g., the CPU logic box 440).

The placement of the removable fan assembly 450, as well as the other modular components housed within the cabinet frame 412, may be shifted as a result of design choices and positional requirements during design and construction. The current configuration shown in the embodiment of FIGS. 4-7 provides leverage of the placement of the removable fan assembly 450 at an edge of the wagering game machine pulling in relatively cool ambient air. The configuration and positioning of the removable fan assembly 450 having specifically oriented component fans 451-453 enables cooling of multiple modular components mounted to the frame 412 simultaneously by supplying air flow in multiple directions. The ability to actively remove the removable fan assembly 450 without disrupting power and operation of the other components of the frame 412 greatly enhances efficiency. Any various jurisdictional requirements to re-obtain a validated seal for a critical-electronics enclosure (e.g., a physically secured and validated CPU logic box 440) are obviated by the ability to actively swap the removable fan assembly 450 during operation without disruption of any security seals. The removable fan assembly 450 avoids interference with various secured portions of the gaming machine 10 and housing 410, removing costly requirements for restarting, rebooting, reinitializing, and revalidating the gaming machine 10. Among other advantages, the removable fan assembly 450 avoids involving a human regulator for removing or placing validated seals (e.g., security tape or other security elements) on components (e.g., CPU logic box 440) during inspection, maintenance, cleaning, replacement of one or more cooling fans of the wagering game machine 10, in jurisdictions where such protocols are required.

The removable fan assembly 450 is further completely independent from all other cabinet fans, LCD fans, etc., allowing specific regions of the interior of the wagering game machine to be selectively cooled by monitoring and modifying the speed of one or more fans in the removable fan assembly 450. The controller(s) that monitor and regulate the status and speed of the various fans and the removable fan assembly 450 may individually monitor and control one or more of the additional fans 451-453 of the removable fan assembly 450, providing dynamic control of air flow in a number of directions simultaneously.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming machine, comprising:

a gaming cabinet;

a backplane within the cabinet;

a power source coupled to the backplane;

a critical-electronics enclosure within the cabinet and coupled to the backplane, the critical-electronics enclosure containing game-logic circuitry associated with at least one regulated casino wagering game, the critical-electronics enclosure having a validated seal that is invalidated in response to opening the critical electronics enclosure or detaching the enclosure from the backplane; and a fan assembly within the cabinet and removably coupled to the backplane, the fan assembly including first and second fans, the first fan arranged to move air in a first direction directly at the game-logic circuitry in the critical electronics enclosure, the second fan arranged to move air in a second direction directly at the power source, the second direction being different than the first direction, the validated seal remaining intact in response to removal of the fan assembly from the cabinet.

2. The gaming machine of claim 1, wherein the first fan is an axial fan, and the second fan is a centrifugal fan.

3. The gaming machine of claim 1, wherein the first and second directions are horizontal and vertical, respectively.

4. The gaming machine of claim 1, wherein the validated seal includes physical tape that is detectably altered when invalidated.

5. The gaming machine of claim 4, wherein the physical tape seals a latch that secures the critical electronics enclosure in place.

6. The gaming machine of claim 1, wherein the validated seal includes electronically coupling the critical electronics enclosure to the backplane, the validated seal being invalidated in response to decoupling the critical electronics enclosure from the backplane.

7. A fan assembly for a gaming machine, the gaming machine including a cabinet constructed to house a frame, a first electronic component, and a second electronic component, the fan assembly comprising:

a housing removably mounted to the frame; and first and second fans mounted within the housing and positioned adjacent to each other, the first fan arranged to move air in a first direction directly at the first electronic component, the second fan arranged to move air in a second direction directly at the second electronic component, the second direction being different than the first direction;

wherein at least one of the first electronic component and the second electronic component are contained within an enclosure mounted to the inside of the cabinet, the enclosure having a validated seal that remains intact in response to removal of the housing.

8. The fan assembly of claim 7, wherein the first and second directions are generally perpendicular to each other.

9. The fan assembly of claim 8, wherein the first and second directions are horizontal and vertical, respectively.

10. The fan assembly of claim 7, wherein the first fan is an axial fan, and the second fan is a centrifugal fan.

11. The fan assembly of claim 7, wherein the first electronic component includes game-logic circuitry associated with a wagering game played via the gaming machine, and the second electronic component includes a power source for powering one or more components of the gaming machine.

12. The fan assembly of claim 11, wherein the fan assembly is removable from the cabinet without removing or opening an enclosure containing the game-logic circuitry.

13. The fan assembly of claim 11, wherein the fan assembly is removable from the cabinet without powering down the gaming machine.

14. A gaming machine, comprising:

a cabinet containing a frame;

first and second electronic components within the cabinet; and a fan assembly including a housing removably mounted to the frame, the fan assembly including first and second fans mounted within the housing and positioned adjacent to each other, the first fan arranged to move air in a first direction directly at the first electronic component, the second fan arranged to move air in a second direction directly at the second electronic component, the second direction being different than the first direction;

wherein at least one of the first electronic component and the second electronic component are contained within an enclosure mounted to the inside of the cabinet, the enclosure having a validated seal that remains intact in response to removal of the housing.

15. The gaming machine of claim 14, wherein the first and second directions are generally perpendicular to each other.

16. The gaming machine of claim 14, wherein the first fan is an axial fan, and the second fan is a centrifugal fan.

17. The gaming machine of claim 14, wherein the first electronic component includes game-logic circuitry associated with a wagering game played via the gaming machine, and the second electronic component includes a power source for powering one or more components of the gaming machine.

18. The gaming machine of claim 17, wherein the fan assembly is removable from the cabinet without removing or opening the enclosure containing the game-logic circuitry.

19. The gaming machine of claim 17, wherein the fan assembly is removable from the cabinet without powering down the gaming machine.

20. The gaming machine of claim 14, wherein the frame includes first, second, and third compartments, the first and second compartments being adjacent to different sides of the third compartment, the first and second electronic components being mounted within the respective first and second compartments and disposed along the respective first and second directions, the fan assembly being mounted within the third compartment.

* * * * *